US005675221A

United States Patent [19]

Yoo et al.

[11] Patent Number: 5,675,221

[45] Date of Patent: Oct. 7, 1997

[54] APPARATUS AND METHOD FOR TRANSMITTING FOWARD/RECEIVING DIMMING CONTROL SIGNAL AND UP/DOWN ENCODING MANNER USING A COMMON USER POWER LINE

[75] Inventors: Hong K. Yoo; Ki J. Im; Sang K. Lee, all of Cheongju; Eun T. Jung, Daejon; Kyung H. Lee, Cheongju; Chang H. Kim, Cheongju; Bog Y. Kang, Cheongju; Byung R. Yang, Cheongju, all of Rep. of Korea

[73] Assignee: LG Industrial Systems Co., Ltd, Seoul, Rep. of Korea

[21] Appl. No.: 541,830

[22] Filed: Oct. 10, 1995

[30] Foreign Application Priority Data

Oct. 12, 1994 [KR] Rep. of Korea ..... 26077/1994

[51] Int. Cl.[6] ..... H05B 37/02

[52] U.S. Cl. ..... 315/291; 315/294; 315/312; 315/316

[58] Field of Search ..... 315/291, 292, 315/293, 294, 312, 313, 314, 315, 316, 194, 199, 318, 295

[56] References Cited

U.S. PATENT DOCUMENTS

| | | | |
|---|---|---|---|
| 4,241,295 | 12/1980 | Williams | 315/294 |
| 4,733,138 | 3/1988 | Pearlman et al. | 315/307 |
| 5,430,356 | 7/1995 | Ference et al. | 315/291 |

*Primary Examiner*—Robert Pascal
*Assistant Examiner*—David Vu
*Attorney, Agent, or Firm*—Oliff & Berridge

[57] ABSTRACT

An apparatus and a method for transmitting a dimming control signal in an up/down encoding manner. A dimming control value and a number of a desired electronic ballast group are set by the user and then encoded into binary data in the up/down manner. The encoded binary data is set as transmission data. A receiving stage receives the transmission data and performs a dimming control operation on the basis of dimming up/down information and electronic ballast group number up/down information of the received data.

10 Claims, 5 Drawing Sheets

APPARATUS AND METHOD FOR TRANSMITTING FOWARD/RECEIVING DIMMING CONTROL SIGNAL AND UP/DOWN ENCODING MANNER USING A COMMON USER POWER LINE

BACKGROUND OF THE INVENTION

1. Field of the Invention

The present invention relates in general to a system for remotely controlling electronic ballasts for fluorescent lamps using a power line, and more particularly to an apparatus and a method for transmitting a dimming control signal in an up/down encoding manner, in which a remote control operation can be performed with no variation in amount of transmission data during a composite dimming operation in which a plurality of dimming control values and electronic ballast groups must be discriminated from one another.

2. Description of the Prior Art

There have generally been proposed various methods for remotely controlling electronic ballast groups or the dimming of fluorescent lamps using a power line. One such control method is a full-erase control method for fully erasing the upper part of sinusoidal wave on the power line at a transmitting stage. Another control method is a partial-erase control method for transmitting a waveform-modulated signal of data at the corresponding phase. Still another control method is to convert dimming data into a binary code and transmit the converted binary code.

However, the full-erase control method has a disadvantage in that a power loss occurs due to the waveform erasure. Also, because the signal transmission is periodically performed, an effective value and a crest factor become smaller, resulting in a reduction in power transmission efficiency. Further, the waveform distortion has a bad effect on other devices, such as electromagnetic interference (EMI). Moreover, an omitted pulse must be transmitted once again to determine a signal cycle. This doubles the power loss.

In the partial-erase control method, it is difficult to discriminate the dimming degrees from one another. Also, the noise and distortion make it hard to discriminate finite time differences in a plurality of electronic ballast groups from one another.

The binary code transmitting method has a disadvantage in that a modulated signal must be extended for a composite dimming operation in which a plurality of dimming control values and electronic ballast groups must be discriminated from one another.

SUMMARY OF THE INVENTION

Therefore, the present invention has been made in view of the above problems, and it is an object of the present invention to provide an apparatus and a method for transmitting a dimming control signal in an up/down encoding manner, in which the dimming control signal includes an individual dimming control value for the control of brightness of individual fluorescent lamps and composite dimming fluorescent lamp group data for the selection of fluorescent lamp groups, and transmitted and received in the up/down encoding manner, so that a remote control operation can stably be performed with no variation in amount of transmission data during a composite dimming operation in which dimming control values and electronic ballast groups must be discriminated from one another.

In accordance with an aspect of the present invention, there is provided an apparatus for transmitting a dimming control signal in an up/down encoding manner, comprising power supply means connected to an AC single-phase power line, for supplying power to the system; zero-crossing detection means connected to the power supply means, for detecting a zero phase of a sinusoidal wave on the power line and generating an interrupt signal upon detecting the zero phase; remote receiving means for receiving an operating signal transmitted from a remote controller in a remote mode; ballast up/down switching means for addressing a desired electronic ballast group in a manual mode; dimming up/down switching means for producing dimming information in the manual mode; mode select switching means for selecting one of the remote mode and the manual mode; clock oscillating means for generating a desired frequency of clock pulse signal; control means for performing a control operation in response to the clock pulse signal from the clock oscillating means and the interrupt signal from the zero-crossing detection means; trigger means for amplifying a trigger current in response to a control signal from the control means and outputting the amplified trigger current as a trigger pulse signal, the trigger means separating the system from the AC single-phase power line; and SCR switching means for erasing a portion of the sinusoidal wave on the AC single-phase power line in response to the trigger pulse signal from the trigger means.

In accordance with another aspect of the present invention, there is provided an apparatus for receiving a dimming control signal in an up/down encoding manner, comprising power supply means connected to an AC single-phase power line, for supplying power to the system; zero-crossing detection means connected to the power supply means, for detecting a zero phase of a sinusoidal wave on the power line and generating an interrupt signal upon detecting the zero phase; clock oscillating means for generating a desired frequency of clock pulse signal; control means for reading electronic ballast group number up/down information and dimming up/down information transmitted through the AC single-phase power line in response to the clock pulse signal from the clock oscillating means and outputting a digital dimming control signal on the basis of the read electronic ballast group number up/down information and dimming up/down information in response to the interrupt signal from the zero-crossing detection means; and digital/analog conversion means for converting the digital dimming control signal from the control means into an analog signal.

In accordance with still another aspect of the present invention, there is provided a method of transmitting a dimming control signal in an up/down encoding manner in a system for remotely controlling electronic ballasts for fluorescent lamps using a power line, comprising the first step of encoding a dimming control value and a number of a desired electronic ballast group into binary data in the up/down manner when they are set by the user and setting the encoded binary data as transmission data; the second step of calculating time from an interrupt point till a restoration point of an erased portion of a signal waveform on the power line and transmitting the transmission data for the calculated time; and the third step of receiving the transmission data and performing a dimming control operation on the basis of dimming up/down information and electronic ballast group number up/down information of the received data.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
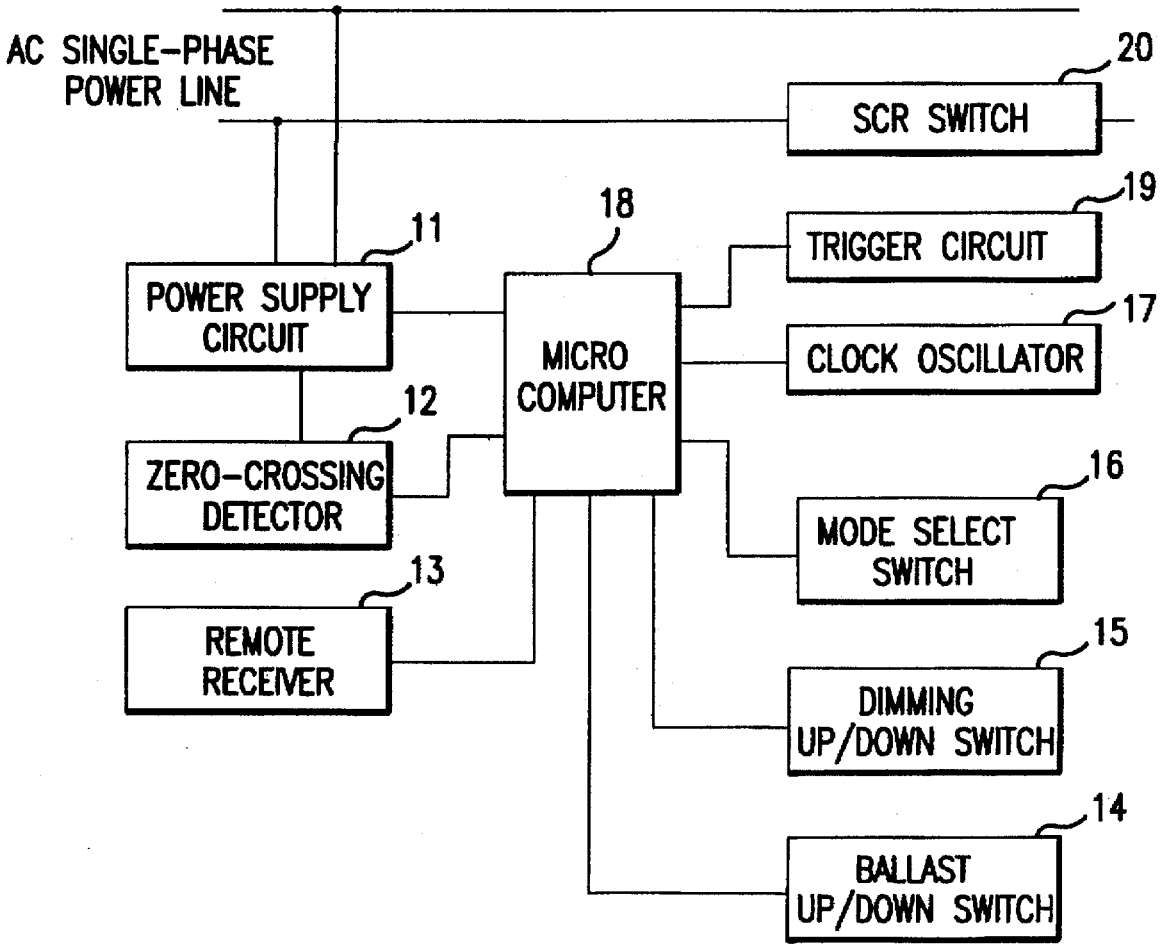
FIG. 1 is a block diagram of a dimming control signal transmitting apparatus using an up/down encoding manner in accordance with the present invention.
Figure 2A:
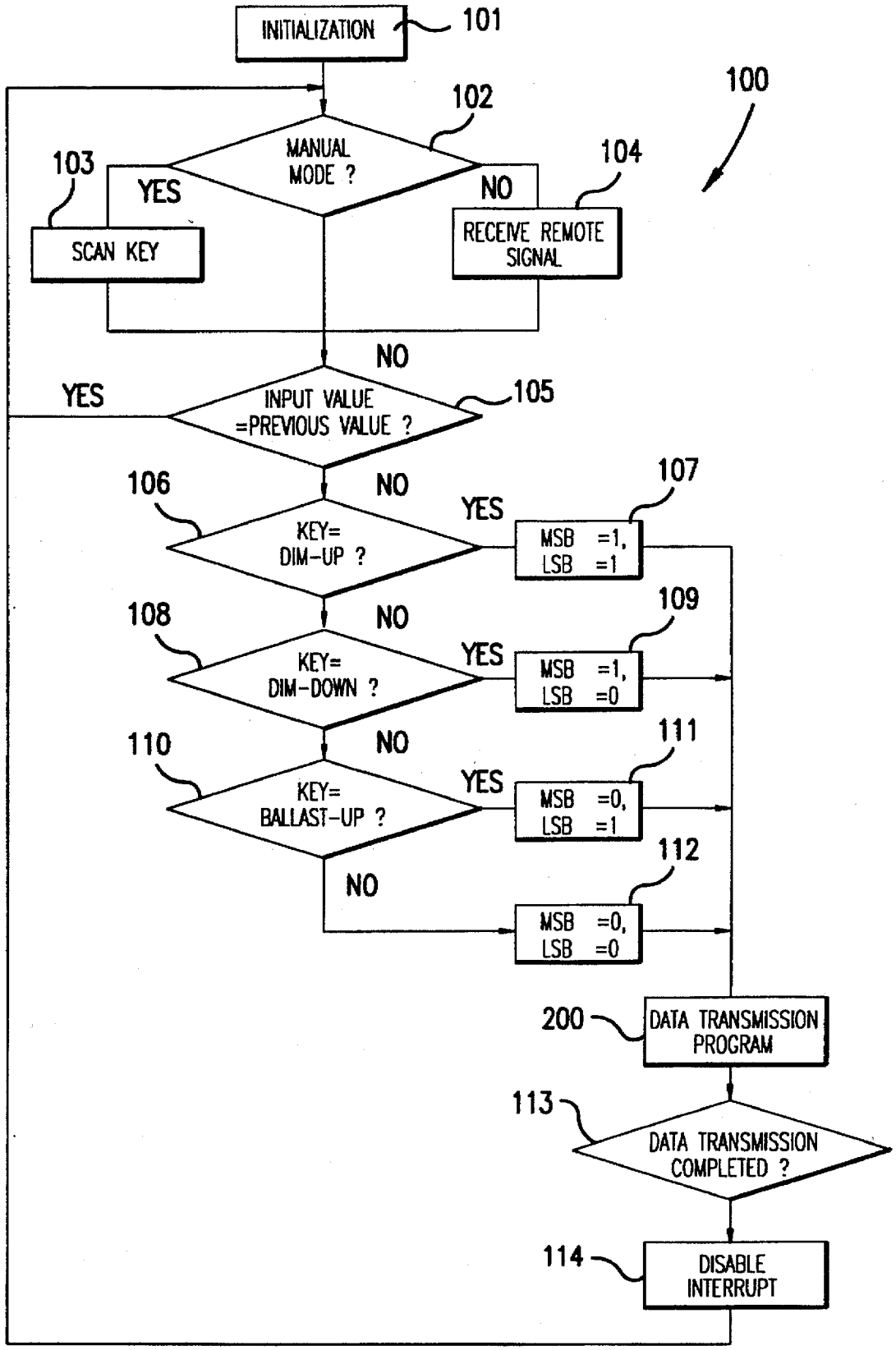
FIG. 2A is a flowchart illustrating a data setting program in FIG. 1.
Figure 2B:
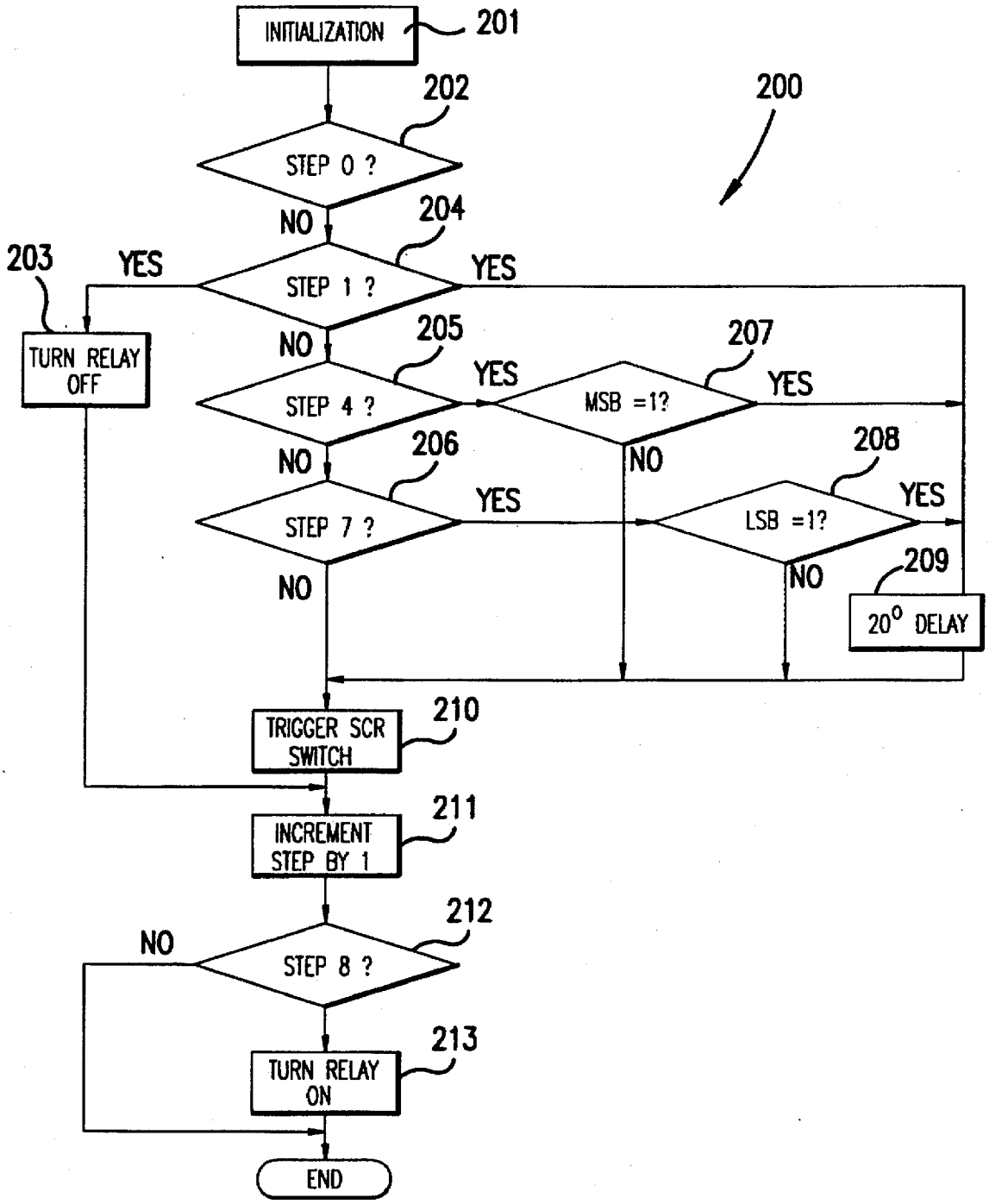
FIG. 2B is a flowchart illustrating a data transmission program in FIG. 1.

Referring to FIG. 1, there is shown a block diagram of a dimming control signal transmitting apparatus using an up/down encoding manner in accordance with the present invention. As shown in this drawing, the dimming control signal transmitting apparatus comprises a power supply circuit 11 connected to an alternating current (referred to hereinafter as AC) single-phase power line to supply power to the system, a zero-crossing detector 12 connected to the power supply circuit 11 to detect a zero phase of a sinusoidal wave on the power line and generate an interrupt signal upon detecting the zero phase, a remote receiver 13 for receiving an operating signal which is transmitted from a remote controller in a remote mode, a ballast up/down switch 14 for addressing a desired electronic ballast group in a manual mode, and a dimming up/down switch 15 for producing dimming information in the manual mode.

The dimming control signal transmitting apparatus further comprises a mode select switch 16 for selecting one of the remote mode and the manual mode, a clock oscillator 17 for generating a desired frequency of clock pulse signal, a microcomputer 18 for performing a control operation in response to the clock pulse signal from the clock oscillator 17 and the interrupt signal from the zero-crossing detector 12, a trigger circuit 19 for amplifying a trigger current in response to a control signal from the microcomputer 18 and outputting the amplified trigger current as a trigger pulse signal, and an SCR switch 20 for erasing a portion of the sinusoidal wave on the power line in response to the trigger pulse signal from the trigger circuit 19.

Figure 3:
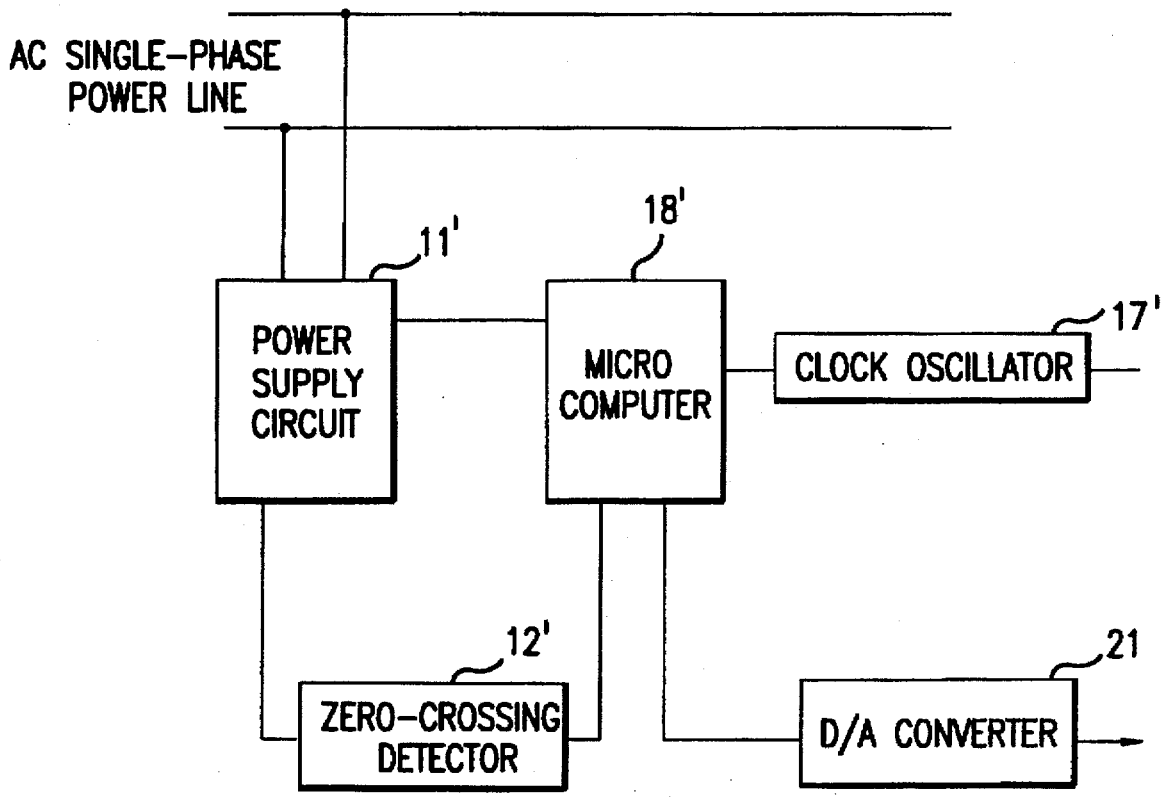
FIG. 3 is a block diagram of a dimming control signal receiving apparatus using the up/down encoding manner in accordance with the present invention.

Referring to FIG. 3, there is shown a block diagram of a dimming control signal receiving apparatus using the up/down encoding manner in accordance with the present invention.

As shown in FIG. 3, the dimming control signal receiving apparatus comprises a power supply circuit 11', a zero-crossing detector 12', a clock oscillator 17' and a microcomputer 18'. The power supply circuit 11' is connected to an AC single-phase power line to supply power to the system. The zero-crossing detector 12' is connected to the power supply circuit 11' to detect a zero phase of a sinusoidal wave on the power line and output the interrupt signal upon detecting the zero phase. The clock oscillator 17' acts to generate a desired frequency of clock pulse signal. The microcomputer 18' reads electronic ballast group number up/down information and dimming up/down information transmitted through the power line in response to the clock pulse signal from the clock oscillator 17'. The microcomputer 18' outputs a digital dimming control signal on the basis of the read electronic ballast group number up/down information and dimming up/down information in response to the interrupt signal from the zero-crossing detector 12'.

The dimming control signal receiving apparatus further comprises a digital/analog (referred to hereinafter as D/A) converter 21 for converting the digital dimming control signal from the microcomputer 18 into an analog signal.

The operation of the dimming control signal transmitting and receiving apparatus with the above-mentioned construction in accordance with the present invention will hereinafter be described in detail with reference to FIGS. 1 to 4.

In accordance with the preferred embodiment of the present invention, the dimming control signal includes an individual dimming control value for the control of brightness of individual fluorescent lamps and composite dimming fluorescent lamp group data for the selection of fluorescent lamp groups, and then transmitted and received in the up/down encoding manner. For the composite dimming operation, the individual dimming control value and the composite dimming fluorescent lamp group data are transmitted and received together.

Also, in the preferred embodiment, the up/down encoding manner utilizes a commercial power line of 60 Hz and a 7-cycle signal waveform thereon. Transmission data is a 2-bit signal obtained by encoding a start signal, dimming up/down information and electronic ballast group number up/down information. The start signal indicates the start of data transmission. The transmission data is transmitted while being assigned to the upper side band of each cycle.

The start signal is modulated in waveform to be 1 in logic for the recognition of the start of data transmission at the receiving stage. The dimming up/down information and the electronic ballast group number up/down information are logically combined into a binary coded number which may be 1 or 0 in logic. The binary coded number is transmitted subsequently to the start signal.

First, the power supply circuit 11 connected to the AC single-phase power line supplies the power to the microcomputer 18 and the zero-crossing detector 12. The zero-crossing detector 12 receives the sinusoidal wave signal of the 60 Hz power line from the power supply circuit 11 and detects the zero phase of the received signal. Upon detecting the zero phase of the sinusoidal wave signal, the zero-crossing detector 12 outputs the interrupt signal to an interrupt terminal of the microcomputer 18.

Thereafter, the user selects the remote mode or the manual mode using the mode select switch 16 and applies the electronic ballast group number information and the dimming information to the microcomputer 18 using the remote receiver 13 or the ballast up/down switch 14 and the dimming up/down switch 15. Under this condition, the microcomputer 18 produces the electronic ballast group number up/down data and the dimming up/down data according to a transmission data setting program 100 shown in FIG. 2A. The microcomputer 18 then performs a data transmission program 200 shown in FIG. 2B from the input of the interrupt signal from the zero-crossing detector 12 till the triggering of the SCR switch 20 to transmit the electronic ballast group number up/down data and the dimming up/down data through the power line.

In the microcomputer 18, the previous key input value is defined as PREV, the trigger timer values of the SCR switch 20 for the waveform modulation by phases are defined as TREGH (TREGL), the data transmission procedure is defined as PROC, and the data transmission completion is defined as DONE. A bit 3 indicates the dimming information and the electronic ballast group number information and a bit 6 indicates the data up/down information, which are temporarily stored in a data storage unit. At initialization step 101 of the transmission data setting program 100 in FIG. 2A, the microcomputer 18 sets the initial values of a stack pointer, an interrupt priority, a TCON register and a TMOD. The microcomputer 18 also sets the initial value of DONE to 1 in logic to indicate that the previous data has been transmitted. The microcomputer 18 also sets the initial value of PROC to 0 in logic to indicate that the present data is not transmitted. The microcomputer 18 further sets the initial value of PREV zero, and sets bit 3 and bit 4 to 0 in logic, respectively.

As mentioned above, the user selects the remote mode or the manual mode using the mode select switch 16 and applies the electronic ballast group number information and the dimming information to the microcomputer 18 using the remote receiver 13 or the ballast up/down switch 14 and the dimming up/down switch 15. In response to an output signal from the mode select switch 16, the microcomputer 18 checks at step 102 whether the present mode is the manual mode or the remote mode. If it is checked at step 102 that the present mode is the manual mode, the microcomputer 18 reads the electronic ballast group number information from the ballast up/down switch 14 and the dimming information from the dimming up/down switch 15 at step 103. On the contrary, if it is checked at step 102 that the present mode is the remote mode, the microcomputer 18 reads a remote key input value from the remote receiver 13.

The microcomputer 18 then compares the key input information from the remote receiver 13 or the ballast up/down switch 14 and the dimming up/down switch 15 with PREV at step 105. If the key input information is equal to PREV at step 105, the microcomputer 18 repeatedly performs the above steps 102–105. On the contrary, if the key input information is not equal to PREV at step 105, the microcomputer 18 checks at step 106 whether the key input information is dim-up.

If it is checked at step 106 that the key input information is dim-up, the microcomputer 18 sets the most significant bit (referred to hereinafter as MSB) or the bit 3 and the least significant bit (referred to hereinafter as LSB) or the bit 6 to 1 in logic, respectively, at step 107. If it is checked at step 106 that the key input information is not dim-up, the microcomputer 18 checks at step 108 whether the key input information is dim-down. If it is checked at step 108 that the key input information is dim-down, the microcomputer 18 sets the MSB or the bit 3 and the LSB or the bit 6 to 1 and 0 in logic, respectively, at step 109. On the contrary, if it is checked at step 108 that the key input information is not dim-down, the microcomputer 18 checks at step 110 whether the key input information is ballast-up. If it is checked at step 110 that the key input information is ballast-up, the microcomputer 18 sets the MSB or the bit 3 and the LSB or the bit 6 to 0 and 1 in logic, respectively, at step 111. On the contrary, if it is checked at step 110 that the key input information is not ballast-up, the microcomputer 18 sets the MSB or the bit 3 and the LSB or the bit 6 to 0 in logic, respectively, at step 112.

Thereafter, when detecting the zero phase of the 7-cycle signal waveform on the power line, the zero-crossing detector 12 applies the interrupt signal to the interrupt terminal of the microcomputer 18. Upon receiving the interrupt signal from the zero-crossing detector 12, the microcomputer 18 stops the data setting program 100 shown in FIG. 2A and proceeds to the data transmission program 200 shown in FIG. 2B to transmit the transmission data set by the data setting program 100 to the receiving stage.

In the data transmission program 200, the microcomputer 18 performs initialization step 201 and then checks at step 202 whether the step of controlling the SCR switch 20 is the initial step. If it is checked at step 202 that the control step is the initial step, the microcomputer 18 turns a system relay off at step 203 and then increments the control step by one at step 211. The microcomputer 18 then checks at step 212 whether the control step is the eighth step in which the data transmission program is completed. If it is checked at step 212 that the control step is the eighth step, the microcomputer 18 turns the system relay on at step 213 and then performs the data setting program 100 again.

On the other hand, if it is checked at step 202 that the control step is not the initial step, the microcomputer 18 checks at step 204 whether the control step is the first step. If it is checked at step 204 that the control step is the first step, the microcomputer 18 delays the phase by 20° at step 209 and triggers the SCR switch 20 at the delayed phase at step 210 to transmit the start signal. As a result, when the interrupt signal is applied, the erased signal waveform on the power line is restored at a position of 20° after the zero-crossing point and then transmitted.

If it is checked at step 204 that the control step is not the first step, the microcomputer 18 checks at step 205 whether the control step is the fourth step. If it is checked at step 205 that the control step is the fourth step, the microcomputer 18 checks at step 207 whether the MSB or the bit 3 set by the data setting program 100 is 1 in logic. When the MSB or the bit 3 is 1 in logic at step 207, the microcomputer 18 delays the phase by 20° at step 209 and triggers the SCR switch 20 at the delayed phase at step 210 to transmit the data through the power line. When the MSB or the bit 3 is 0 in logic at step 207, the microcomputer 18 triggers the SCR switch 20 directly at step 210 to transmit the data through the power line. On the contrary, if it is checked at step 205 that the control step is not the fourth step, the microcomputer 18 checks at step 206 whether the control step is the seventh step. If it is checked at step 206 that the control step is the seventh step, the microcomputer 18 checks at step 208 whether the LSB or the bit 6 set by the data setting program 100 is 1 in logic. When the LSB or the bit 6 is 1 in logic at step 208, the microcomputer 18 delays the phase by 20° at step 209 and triggers the SCR switch 20 at the delayed phase at step 210 to transmit the data through the power line. When the LSB or the bit 6 is 0 in logic at step 208, the microcomputer 18 triggers the SCR switch 20 directly at step 210 to transmit the data through the power line.

Then, the microcomputer 18 increments the control step by one. If the incremented control step is the eighth step, the microcomputer 18 turns the system relay on and stops the data transmission program 200. The microcomputer 18 then returns to the data setting program 100 to check at step 113 whether the data transmission has been completed. If it is checked at step 113 that the data transmission has been completed, the microcomputer 18 disables the interrupt at step 114 and then returns to step 102 to perform the above steps repeatedly.

In this manner, the dimming control signal transmitting apparatus of FIG. 1 transmits the dimming information and the electronic ballast group number information to the dimming control signal receiving apparatus of FIG. 3 through the AC single-phase power line.

In the dimming control signal receiving apparatus, the power supply circuit 11' connected to the AC single-phase power line supplies the power to the microcomputer 18' and the zero-crossing detector 12'. The zero-crossing detector 12' receives the sinusoidal wave signal of the 60 Hz power line from the power supply circuit 11' and detects the zero phase of the received signal. Upon detecting the zero phase of the sinusoidal wave signal, the zero-crossing detector 12' outputs the interrupt signal to the interrupt terminal of the microcomputer 18'. The microcomputer 18' receives the electronic ballast group number information and the dimming information from the dimming control signal transmitting apparatus of FIG. 1 in response to the clock pulse signal from the clock oscillator 17'. The microcomputer 18' then performs a data receiving program 300 shown in FIG. 4 on the basis of the received electronic ballast group number information and dimming information to read the electronic ballast group number up/down information and the dimming up/down information. Then, the microcomputer 18' calculates the time from the interrupt point till the end point of the upper part of the sinusoidal wave on the power line and outputs the electronic ballast group number and the dimming value to the D/A converter 21 for the calculated time. The D/A converter 21 converts the electronic ballast group number and the dimming value from the microcomputer 18' into an analog signal. In result, the output signal from the D/A converter 21 controls a dimming state of a desired electronic ballast group.

Figure 4:
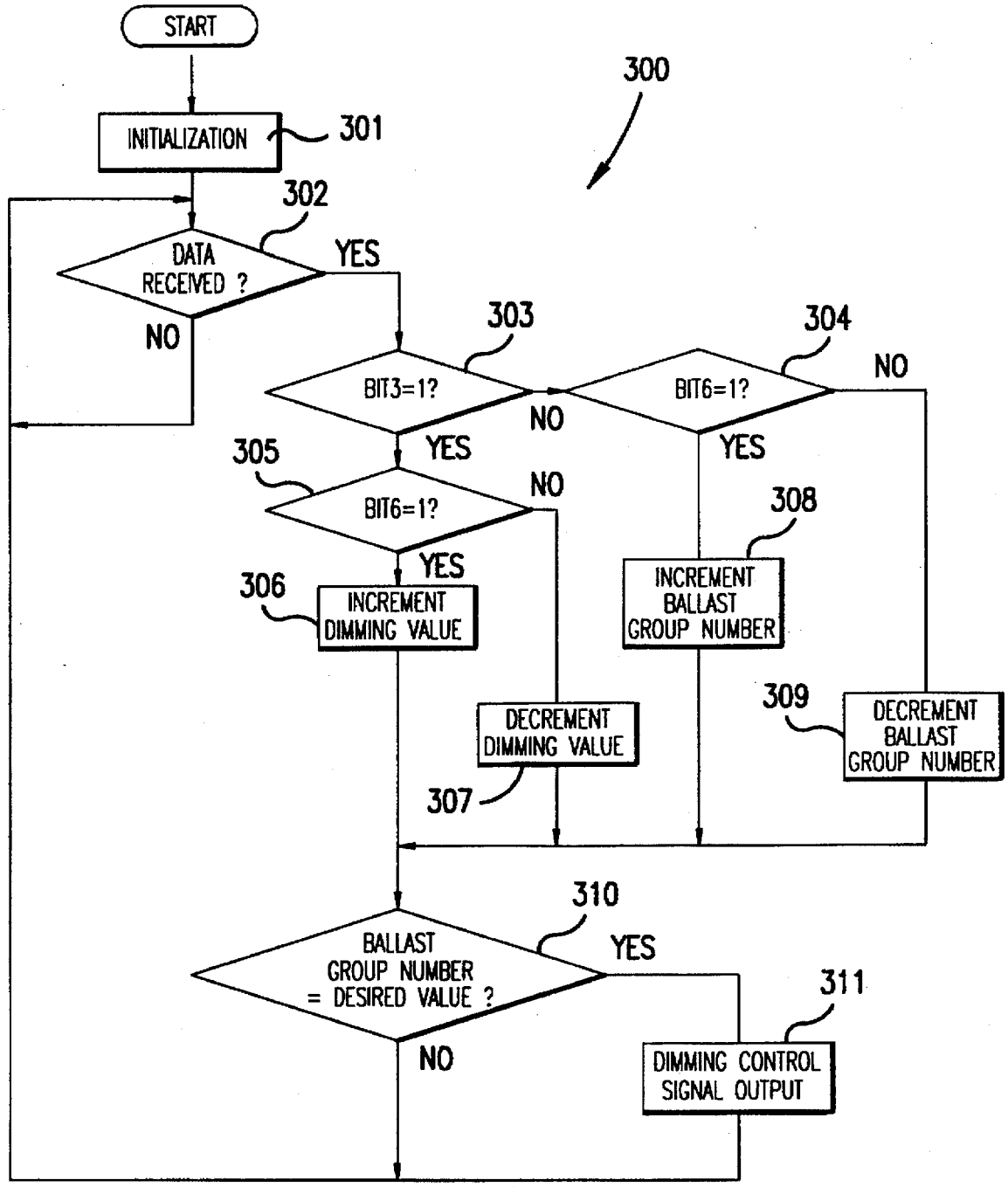
FIG. 4 is a flowchart illustrating a data receiving program in FIG. 3.

In detail, the microcomputer 18' sets the initial values of BALL and DIMM at initialization step 301 of FIG. 4, which indicate the present electronic ballast group number and dimming value, respectively. The microcomputer 18' checks at step 302 whether data has been received. If it is checked at step 302 that data has been received, the microcomputer 18' checks at step 303 whether the bit 3 indicative of the dimming information and the electronic ballast group number information is 1 in logic.

If it is checked at step 303 that the bit 3 is not 1 in logic, the microcomputer 18' checks at step 304 whether the bit 6 indicative of the data up/down information is 1 in logic. If it is checked at step 304 that the bit 6 is 1 in logic, the microcomputer 18' increments the electronic ballast group number at step 308. On the contrary, if it is checked at step 304 that the bit 6 is not 1 in logic, the microcomputer 18' decrements the electronic ballast group number at step 309.

On the other hand, when the bit 3 is 1 in logic at step 303, the microcomputer 18' checks at step 305 whether the bit 6 is 1 in logic. If it is checked at step 305 that the bit 6 is 1 in logic, the microcomputer 18' increments the dimming value at step 306. On the contrary, if it is checked at step 305 that the bit 6 is not 1 in logic, the microcomputer 18' decrements the dimming value at step 307.

DAO is a parameter indicative of the dimming step and has the maximum value set to 4 and the minimum value set to 0. When DAO has the minimum value set to 0, the dimming step is not incremented and decremented.

BALL indicative of the present electronic ballast group number has the maximum value set to 4 and the minimum value set to 0. When the increment command is given under the condition that BALL has the maximum value set to 4, BALL is adjusted to have 0. In the case where the decrement command is given under the condition that BALL has the minimum value set to 0, BALL is adjusted to have 4. In this manner, BALL is circularly incremented and decremented.

The microcomputer 18' checks at step 310 whether the present electronic ballast group number is a desired value. If it is checked at step 310 that the present electronic ballast group number is not the desired value, the microcomputer 18' returns to step 302. On the contrary, if it is checked at step 310 that the present electronic ballast group number is the desired value, the microcomputer 18' calculates the time from the interrupt point till the end point of the upper part of the sinusoidal wave on the power line and outputs the electronic ballast group number and the dimming value to the D/A converter 21 for the calculated time. The D/A converter 21 converts the electronic ballast group number and the dimming value from the microcomputer 18' into an analog signal at step 311. In result, the output signal from the D/A converter 21 controls a dimming state of a desired electronic ballast group.

Therefore, the D/A converter 21 converts the digital signal produced by the receiving program 300 of the microcomputer 18' into the analog signal for the control of the dimming state of desired electronic ballast group.

As apparent from the above description, according to the present invention, the start signal, the dimming up/down information and the electronic ballast group number up/down information are encoded into the dimming control signal. The encoded dimming control signal is transmitted while being placed on the erased upper part of the sinusoidal wave signal on the power line. Therefore, the present invention can prevent noise and distortion and reduce transmission power loss. Further, the present invention can significantly reduce the number of actual transmission data as compared with the conventional technique employing the simple encoding manner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for transmitting a dimming control in an up/down encoding manner using a common use power line, comprising:

power supply means connected to an AC single-phase common use power line, for supplying power to a lighting system;

zero-crossing detection means connected to said power supply means, for detecting a zero-phase of a sinusoidal wave on said power line and generating an interrupt signal upon detecting the zero-phase;

remote receiving means for receiving an operating signal transmitted from a remote controller in a remote mode;

ballast up/down switching means for addressing a desired electronic ballast group in a manual mode;

dimming up/down switching means for producing dimming information in the manual mode;

mode select switching means for selecting one of the remote mode and the manual mode;

clock oscillating means for generating a desired frequency of clock pulse signals;

control means for performing a control operation in response to the clock pulse signal from said clock oscillating means, the control operation including controlling a phase erasing operation in response to the interrupt signal from said zero-crossing detection means, and transmitting encoded electronic ballast group number up/down information and dimming up/down information through said AC single-phase common use power line;

trigger means for amplifying a trigger current in response to a control signal from said control means and outputting the amplified trigger current as a trigger pulse signal; and SCR switching means for erasing a portion of the sinusoidal wave on said AC single-phase common use power line responsive to the trigger pulse signal from said trigger means.

2. An apparatus for receiving a dimming signal in an up/down encoding manner using a common use power line, comprising:

power supply means connected to an AC single-phase common use power line, for supplying power to the system;

zero-crossing detection means connected to said power supply means, for detecting a zero phase of a sinusoidal wave on said power line and generating an interrupt signal upon detecting the zero phase;

clock oscillating means for generating a desired frequency of clock pulse signal;

control means for performing a control operation in response to the clock pulse signal from said clock oscillating means, the control operation including reading encoded electronic ballast group number up/down information and dimming up/down information received through said AC single-phase common use power line, outputting a digital dimming control signal on the basis of the read electronic ballast group number up/down information and dimming up/down information in response to the interrupt signal from said zero-crossing detection means; and digital/analog conversion means for converting the digital dimming control signal from the control means into an analog signal.

3. A method of transmitting a dimming control signal in an up/down encoding manner in a system for remotely controlling electronic ballasts for fluorescent lamps using an AC single phase common use power line, comprising the steps of:

(a) encoding a dimming control value and a number of a desired electronic ballast group into binary data in the up/down manner when they are set by the user and setting the encoded binary data as transmission data;

(b) calculating time from an interrupt point till a restoration point of an erased portion of a signal waveform on said Ac single phase common use power line and transmitting the transmission data through said AC single phase common use power line for the calculated time; and (c) receiving the transmission data and performing a dimming control operation on the basis of dimming up/down information and electronic ballast group number up/down information of the received data.

4. A method of transmitting a dimming control signal in an up/down encoding manner, as set forth in claim 3, wherein said step (a) includes the steps of:

(a-1) performing a system initializing operation and checking whether the present mode selected by the user is a manual mode or a remote mode; and (a-2) comparing key input information from the user with the previous value and encoding the key input information into the binary data in the up/down manner if the key input information is not equal to the previous value as a result of the comparison.

5. A method of transmitting a dimming control signal in an up/down encoding manner, as set forth in claim 4, wherein said step (a-2) includes the steps of:

setting a most significant bit and a least significant bit of the transmission data to 1 in logic, respectively, if the key input information is dim-up;

setting the most significant bit and the least significant bit of the transmission data to 1 and 0 in logic, respectively, if the key input information is dim-down;

setting the most significant bit and the least significant bit of the transmission data to 0 and 1 in logic, respectively, if the key input information is ballast-up; and setting the most significant bit and the least significant bit of the transmission data to 0 and 0 in logic, respectively, if the key input information is ballast-down.

6. A method of transmitting a dimming control signal in an up/down encoding manner, as set forth in claim 5, wherein the most significant bit of the transmission data indicates the dimming information and the electronic ballast group number information, and the least significant bit of the transmission data indicates the data up/down information.

7. A method of transmitting a dimming control signal in an up/down encoding manner, as set forth in claim 3, wherein the erased portion of the signal waveform on said power line is restored at a position of 20° after a zero-crossing point thereof.

8. A method of transmitting a dimming control signal in an up/down encoding manner, as set forth in claim 7, wherein the erased portion of the signal waveform on said power line is restored when the transmission data is 1 in logic.

9. A method of transmitting a dimming control signal in an up/down encoding manner, as set forth in claim 3, wherein said step (c) includes the steps of:

(c-1) initializing the present electronic ballast group number and dimming value and checking whether the transmission data has been received;

(c-2) checking a most significant bit and a least significant bit of the transmission data if it is checked that the transmission data has been received and reading the dimming up/down information and the electronic ballast group number up/down information in accordance with the checked result; and (c-3) determining a dimming control value and a number of an electronic ballast group according to the read dimming up/down information and electronic ballast group number up/down information, checking whether the determined electronic ballast group number is equal to that of the desired electronic ballast group and controlling a dimming state of the desired electronic ballast group on the basis of the determined dimming control value if it is checked that the determined electronic ballast group number is equal to that of the desired electronic ballast group.

10. A method of transmitting a dimming control signal in an up/down encoding manner, as set forth in claim 9, wherein said step (c-2) includes the steps of:

incrementing the electronic ballast group number if the most significant bit and the least significant bit of the transmission data are 0 and 1 in logic, respectively;

decrementing the electronic ballast group number if the most significant bit and the least significant bit of the transmission data are both 0 in logic;

incrementing the dimming control value if the most significant bit and the least significant bit of the transmission data are both 1 in logic; and decrementing the dimming control value if the most significant bit and the least significant bit of the transmission data are 1 and 0 in logic, respectively.

* * * * *